United States Patent [19]

Tamura et al.

[11] 4,270,198

[45] May 26, 1981

[54] ELECTRONIC TIMEPIECE

[76] Inventors: Munetaka Tamura, No. 32-18, 2-Chome, Igusa, Suginami-ku, Tokyo; Toshikazu Hatuse, No. 23-10, 4-Chome, Shibakubo-cho, Tanashi-shi, Tokyo, both of Japan

[21] Appl. No.: 84,127

[22] Filed: Oct. 12, 1979

Related U.S. Application Data

[63] Continuation-in-part of Ser. No. 862,141, Dec. 19, 1977, abandoned.

[30] Foreign Application Priority Data

Dec. 22, 1976 [JP] Japan ..... 51-154773
Jan. 11, 1977 [JP] Japan ..... 52-1783

[51] Int. Cl.[3] ..... G04B 19/02; G04C 3/00; G04C 5/00; G04C 19/00

[52] U.S. Cl. ..... 368/220; 368/217; 368/85; 368/76; 368/155

[58] Field of Search ..... 58/7, 23 R, 23 D, 39.5, 58/127 R, 85.5; 368/62, 76, 85–87, 217–319, 220, 155

[56] References Cited

U.S. PATENT DOCUMENTS

| | | | |
|---|---|---|---|
| 3,662,535 | 8/1972 | Aedrick et al. | 58/39.5 |
| 4,070,822 | 1/1978 | Arai | 58/38 R |
| 4,175,372 | 11/1979 | Tamura et al. | 368/85 |

*Primary Examiner*—S. J. Witkowski
*Assistant Examiner*—John B. Conklin

[57] ABSTRACT

An electronic timepiece having a frequency standard, a frequency converter, a control circuit responsive to a low frequency time unit signal to provide first and second output signals, and a driver circuit responsive to the first and second output signals to provide first and second drive signals, which timepiece comprises a reversible electro-mechanical transducer rotatable in a clockwise direction in response to the first drive signal and in a counter-clockwise direction in response to the second drive signal, first and second wheel trains driven by the electro-mechanical transducer independently from each other, and first and second time indicating means actuated by the first and second wheel trains, respectively.

9 Claims, 7 Drawing Figures

ELECTRONIC TIMEPIECE

BACKGROUND OF THE INVENTION

This application is a continuation-in-part of patent application Ser. No. 862,141 filed Dec. 19, 1977 and now abandoned.

This invention relates to electronic timepieces and, more particularly, to an electronic timepiece having time indicating hands driven by an electro-mechanical transducer.

In prior art timepieces of this type, the seconds, minutes and hours hands were driven by reducing step-wise the rotational speed of an electro-mechanical transducer so that the hands could be advanced in order to decreasing rotational speed. Accordingly, all of the time indicating members and their associated wheel trains were driven at the same time, and the rotational speed was limited by the fastest moving time indicating member. As a result, the electro-mechanical transducer required a large output, and thus it was necessary to consider not only current consumption but also a drop in power supply voltage. On the other hand, time adjustment systems that operate by supplying a correction signal directly to the electro-mechanical transducer have recently appeared, although these are defective in that a correction is a time consuming process since the rotational speed of the electro-mechanical transducer is limited whenever a time correction is attempted in regular sequence from the fastest rotating time indicating member (the second of a 3-hand timepiece) to the slowest rotating member (the hour hand of a 3-hand timepiece). A 12-hour time correction takes over two minutes to perform even in the case of a 2-hand timepiece the minute hand of which is incremented once at five second intervals as governed by an electro-mechanical transducer that operates at a frequency of 64 Hz. One movement per second in a 2-hand timepiece, such as can be obtained in a timepiece with a seconds hand, has been difficult to realize.

SUMMARY OF THE INVENTION

It is, therefore, an object of the present invention to provide an electronic timepiece having an electro-mechanical transducer means adapted to be driven under a relatively low load whereby a power consumption is reduced to a low value.

It is another object of the present invention to provide an electronic timepiece incorporating a reversible electro-mechanical transducer means adapted to drive first and second wheel trains separately by which first and second time indicating hands are actuated, respectively, in a separate manner.

It is still another object of the present invention to provide an electronic timepiece incorporating a reversible electro-mechanical transducer of which clockwise rotation is utilized for driving a first wheel train connected to a seconds hand and counter-clockwise rotation is utilized for driving a second wheel train connected to a minutes hand and an hours hand.

It is a further object of the present invention to provide an electronic timepiece having a reversible electro-mechanical transducer means connected to first and second wheel trains independent from each other to separately actuate a seconds hand, and minutes and hours hands, in which the second wheel train is actuated only at predetermined time instants, i.e., every ten seconds.

It is a still further object of the present invention to provide an electronic timepiece incorporating a reversible electro-mechanical transducer means and time correction switch means to quickly correct a seconds hand and hours and minutes hands independently from each other.

BRIEF DESCRIPTION OF THE DRAWINGS

These and other objects, features and advantages of the present invention will become more apparent from the following description when taken in conjunction with the accompanying drawings, in which:

FIGS. 5 and 6 show another preferred embodiment of the invention, in which FIG. 5 is a plan view showing the external appearance of a timepiece and FIG. 6 is a block wiring diagram showing the structure of the timepiece shown in FIG. 5.

DESCRIPTION OF THE PREFERRED EMBODIMENTS

Figure 1:
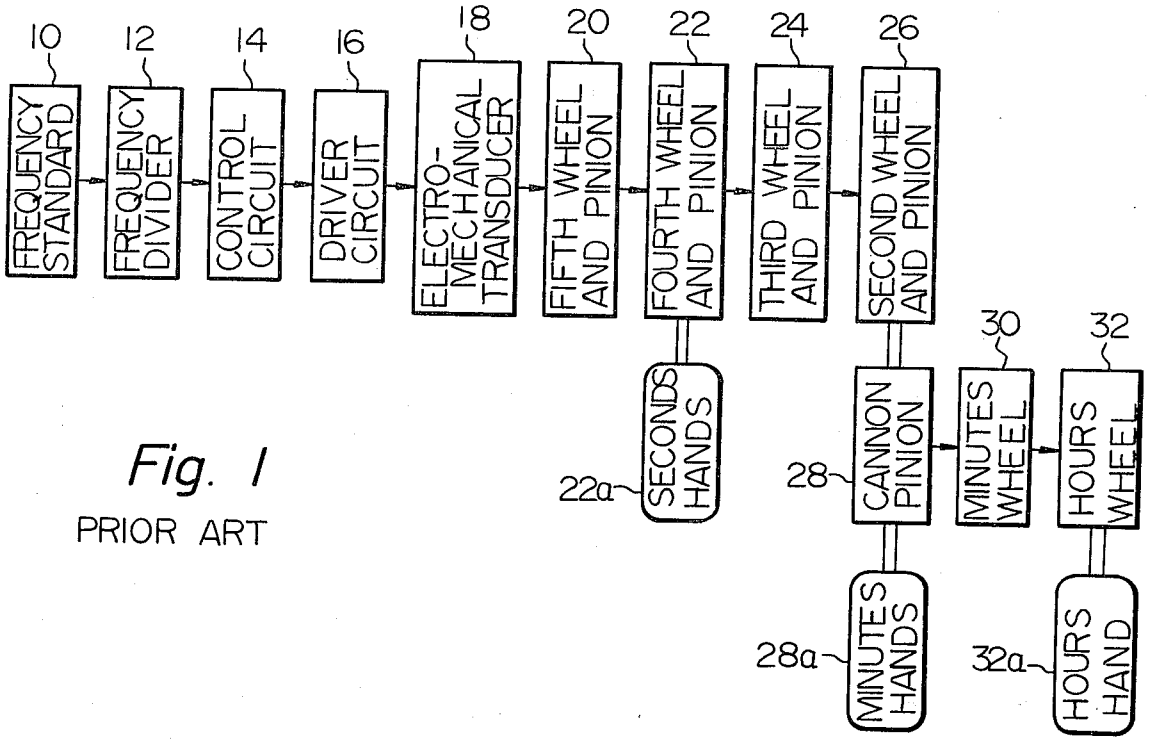
Fig. 1 PRIOR ART
FIG. 1 is a block wiring diagram of a prior art timepiece system.

FIG. 1 is a block wiring diagram of a conventional timepiece system. A relatively high frequency signal obtained from a frequency standard 10 is divided by a frequency divider 12 to provide a low frequency time unit signal. The time unit signal is applied to a driver circuit 16 through a control circuit 14 which may be composed of a wave shaping circuitry and reset circuitry for time corrections. The output of the driver circuit 16 drives an electro-mechanical transducer 18, which is generally capable of rotating in a single direction only, the transducer causing the fifth wheel and pinion 20 to rotate. The rotation of the fifth wheel and pinion 20 is transmitted to, and thus drives, a fourth wheel and pinion 22 which mounts a second hand **22*a*, a third wheel and pinion 24, a second wheel and pinion 26 integrated with an hours wheel pinion 28 which mounts a minutes head 28*a*, a minutes wheel 30, and an hours wheel 32 which mounts an hours hand 32*a*. In other words, rotation is transmitted through a single path to achieve rotation of the seconds hand 22*a*, minutes hand 28*a*, hours hand 32*a*, as well as a calendar date indicator and other indicators which are not shown. With the structure shown in FIG. 1**, since all of the time indicating members and their associated wheel trains are driven at the same time, the electro-mechanical transducer requires a large output and a large power consumption is caused. Another drawback is encountered in that a longer time is required before the slowest rotating time indicating member such as the hours hand is corrected in response to higher frequency correction pulses.

The present invention contemplates the provision of an electronic timepiece in which a power consumption is remarkably reduced and time correction can be quickly performed even for the slowest rotating time indicating member such as an hours hand.

Figure 2:
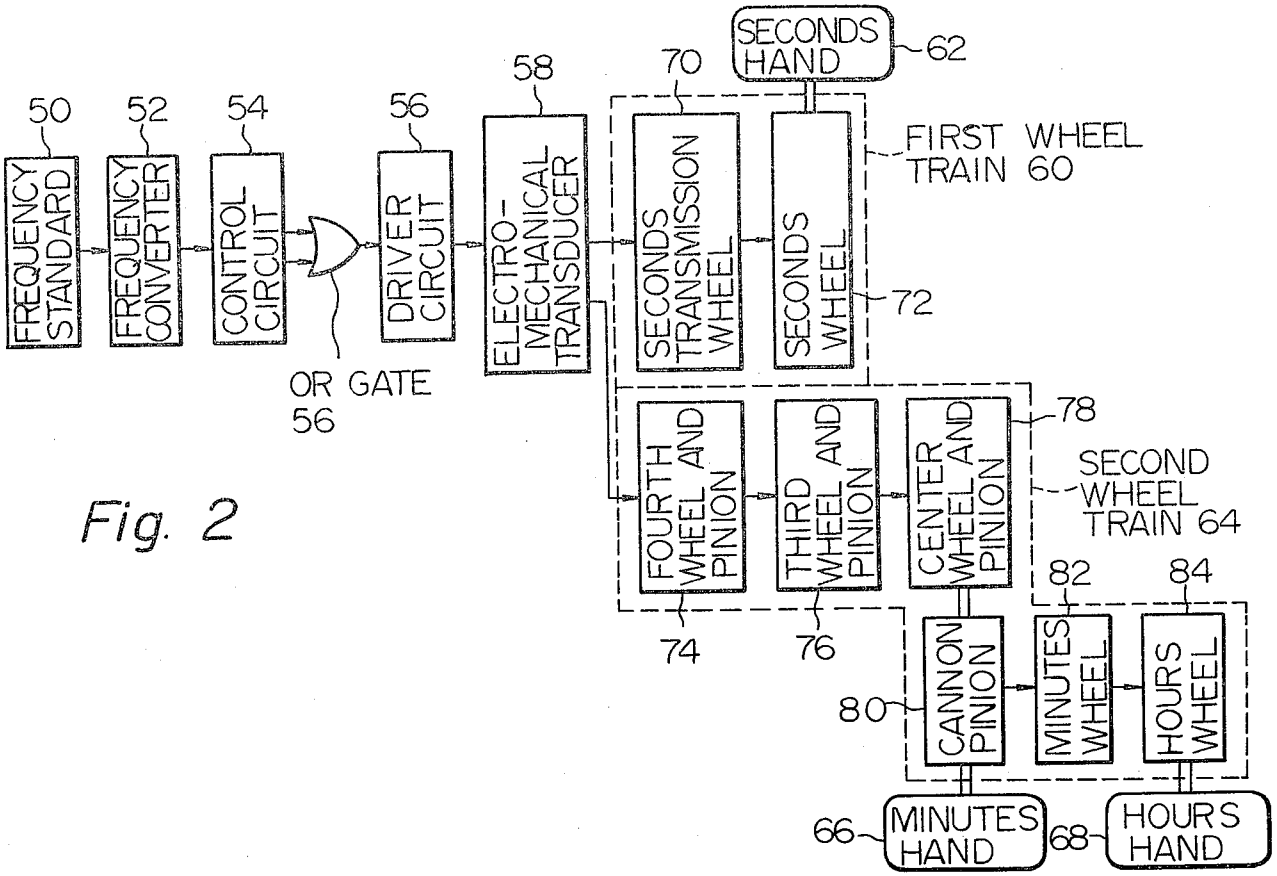
FIG. 2 is a block wiring diagram of a preferred embodiment of an electronic timepiece according to the invention.

A preferred embodiment of an electronic timepiece to achieve the above concept is illustrated in a block diagram of FIG. 2.

In FIG. 2, the electronic timepiece generally comprises a frequency standard 50, a frequency converter 52, a control circuit 54, an OR gate 56, an electro-mechanical transducer 58, a first wheel train 60 for actuating a first or seconds hand 62, and a second wheel train 64 for actuating a second or minutes hand 66 and a third or hours hand 68.

Figure 4:
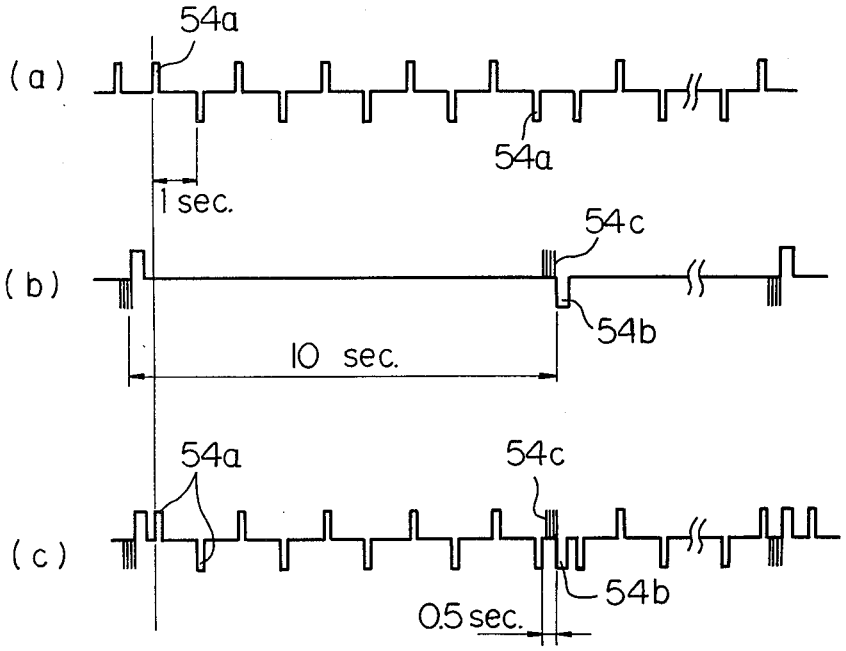
FIG. 4 is a timing chart showing the waveforms that are supplied to the driver circuit shown in FIG. 2.

The frequency standard 50 is controlled by a quartz crystal oscillator (not shown), to generate a relatively high frequency signal of, for example, 32,768 Hz. This relatively high frequency signal is applied to the frequency converter 52, which is composed of a divider circuit including a plurality of flip-flops to provide a low frequency time unit signal of, for example, 1 Hz. The time unit signal is applied to the control circuit 54, which may comprise a waveshaping circuit to shape the waveform of the time unit signal, a first circuit means responsive to the time unit signal to provide a seconds advance signal composed of a train of first alternating voltage signals of 1 Hz as shown by the waveform (a) in FIG. 4, and a minutes and hours advance signal composed of a train of second alternating voltage signals of 1/10 Hz as shown by the waveform (b) in FIG. 4. The control circuit 54 is so arranged as to generate the signal **54*b* 0.5 seconds after the arrival of the 10th seconds advance signal 54*a* such that the minutes hand 66 and the hours hand 68 are advanced while the seconds hand 62 is at rest, i.e., during a time interval in which the seconds advance signal 54*a* is absent. The train of first alternating voltage signals are utilized for driving the electro-mechanical transducer 58 in a normal or clockwise direction to actuate the first wheel train 60 by which the seconds hand 62 is advanced one step per second. The second train of alternating voltage signals are utilized for driving the electro-mechanical transducer 58 in a reverse or counter-clockwise direction to actuate the second wheel train 64 by which the minutes hand 66 and the hours hand 68 are advanced one step every 10 seconds. To this end, the first and second trains of alternating voltage signals are applied to the OR gate 56, which serves as a synthesizing circuit to generate an output signal composed of the first alternating voltage signals 54*a* and the second alternating voltage signals 54*b* as shown by the waveform (c) in FIG. 4. Indicated as 54*c* in FIG. 4 is an auxiliary signal composed of a burst of narrow pulses that allows the electro-mechanical transducer 58 to smoothly reverse in direction. The minutes and hours advance signal 54*b* has a wider pulse width than the seconds advance signal 54*a*** so that a calendar display mechanism (not shown) may be actuated.

Figure 3:
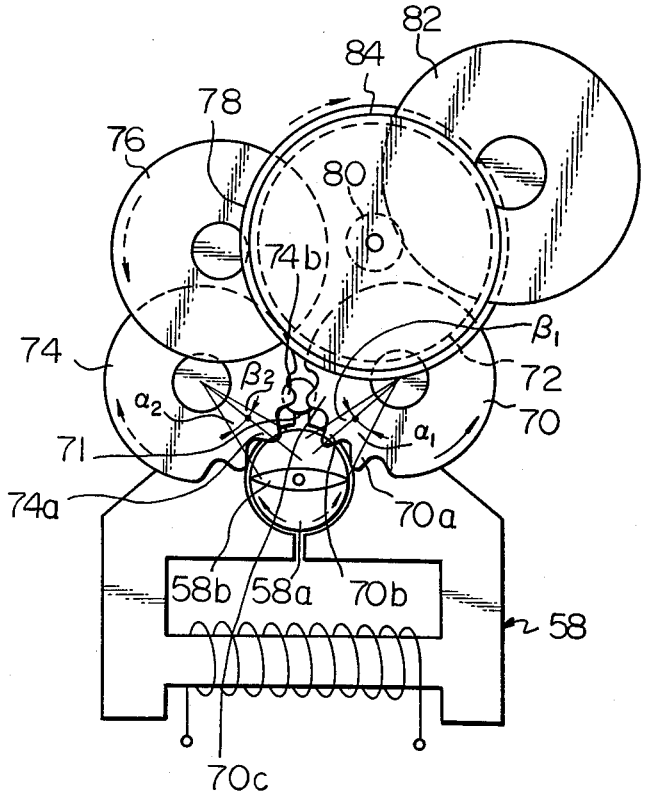
FIG. 3 is a structural diagram showing the drive pawl of an electro-mechanical transducer and associated wheel trains.

The output signal from the OR gate 50 is applied through the driver circuit 56 to the electro-mechanical transducer 58. In this illustrated embodiment, the electro-mechanical transducer 58 comprises a reversible stepping motor which rotates clockwise by 180° C. each time a seconds advance signal **54*a* arrives and also rotates counter-clockwise by 180° C. every ten seconds in response to the minutes and hours advance signal 54*b*. The clockwise rotation of the electro-mechanical transducer 58 is transmitted to the first wheel train 60. The first wheel train 60 comprises a seconds transmission wheel 70 adapted to be rotated by the electro-mechanical transducer 58, and a seconds wheel 72 driven by the seconds transmission wheel 70 and connected to the seconds hand 62. As shown in FIG. 3, the electro-mechanical transducer 58 has a rotor 58*a* to which a drive pawl 58*b* is fixedly mounted. The seconds transmission wheel 70 is positioned with respect to the pawl 58*b* of the rotor 58*a* such that the seconds transmission wheel 70 is advanced counterclockwise one step per second by the drive pawl 58*b* of the rotor 58*a* against the action of a positioning magnet 71 acting on each teeth 70*a* of the seconds transmission wheel. Similarly, the counter-clockwise rotation of the electro-mechanical transducer 58 is transmitted to the second wheel train 64. As shown in FIGS. 2 and 3, the second wheel train 64 comprises a fourth wheel and pinion 74 driven by the drive pawl 58*b* of the rotor, a third wheel and pinion 76 driven by the fourth wheel and pinion 74, a center wheel and pinion 78 carrying thereon a cannon pinion 80 connected to the minutes hand 66, minutes wheel 82 driven by the cannon pinion 80, and an hours wheel 84 driven by the minutes wheel 82 to actuate the hours hand 68**.

Examining first only the relationship between the drive pawl **58*b* and the seconds transmission wheel 70, it can be seen from FIG. 3 that in the equilibrium condition, prior to rotation of drive pawl 58*b*, the radial axis of tooth 70*b* of seconds transmission wheel 70 forms an offset angle with respect to a line drawn between the centers of rotation of the seconds transmission wheel and drive pawl 58*b*, i.e. with respect to the common diameter of the seconds transmission wheel 70 and the circle of rotation traced out by the tip of drive pawl 58*b*. The term "radial axis" as used herein means a line drawn from the center of a gear wheel through the apex of a tooth of that gear wheel. If the radial axis of tooth 70*b*, for example, were aligned with the line between the center of seconds transmission wheel 70 and the circle of rotation of drive pawl 58*b*, then wheel 70 would be rotated through equal angles as a result of the action of drive pawl 58*b* upon tooth 70*b* when drive pawl 58*b* rotates in the clockwise and counterclockwise directions, respectively. However due to the offset angle formed between the radial axis of tooth 70*b* and the common diameter of wheel 70 and the circle of rotation of drive pawl 58*b*, wheel 70 is rotated through a relatively small angle (denoted as angle $\beta_1$ in FIG. 3) when drive pawl 58*b* acts on tooth 70*b* while rotating in the counter-clockwise direction, while wheel 70 is rotated through a relatively large angle (denoted as $\alpha_1$ in FIG. 3) when drive pawl 68*b* acts on tooth 70*b* while rotating in the clockwise direction. Prior to gearwheel 70 being moved by the drive pawl 58*b*, one of the teeth of the wheel 70 is held in a fixed position by the attraction of positioning magnet 71, causing tooth 70*b* to be positioned with its radial axis at the offset angle described above with respect to the common diameter of wheel 70 and the circle of rotation of drive pawl 58*b*. If drive pawl 58*b* rotates in the counter-counter-clockwise direction, so that tooth 70*b* is moved through the relatively small angle $\beta_1$, then the tooth of the wheel 70 which is currently being attracted by positioning magnet 71 will be maintained in a condition of attraction to the positioning magnet 71, and therefore will return to its previous position, so that no net movement of wheel 70 occurs as a result of contact between tooth 70*b* and drive pawl 58*b* when drive pawl 58*b* moves in the counter clockwise direction. If, however, tooth 70*b* is acted on by drive pawl 58*b* when the latter rotates in the clockwise direction, and is thereby rotated through the larger angle $\alpha_1$, then the tooth 70c of gear wheel 70, which was currently being held in an attracted condition by positioning magnet 71, will be moved sufficiently far as to leave the range of effective attraction of positioning magnet 71, and the succeeding tooth to the tooth 70c will be brought into a state of attraction by positioning magnet 71. Thus, as a result of contact between drive pawl 58b and tooth 70b of gear wheel 70, a net movement of gear wheel 70 in the counter clockwise direction has occurred, and this movement has an amplitude of one gear pitch of gear wheel 70, as successive teeth gear wheel 70 are captured by the attractive force of positioning magnet 71, one after the other. Rotation of the seconds transmission wheel 70 in the counterclockwise direction as a result of rotation of drive pawl 58b in the clockwise direction therefore occurs, while no net movement of the seconds transmission wheel 70 occurs as a result of rotation of drive pawl 58b** in the counterclockwise direction.

Similarly, tooth 74a of fourth wheel and pinion 74 is held with its radial axis aligned at an offset angle with respect to the common diameter of the fourth wheel and pinion 74 and the circle of rotation of the drive pawl 58b, in the equilibrium condition before drive pawl 58b is rotated. Tooth 74a is held in this position due to the attractive force of positioning magnet 71 acting upon tooth 74b of the fourth wheel and pinion 74. If drive pawl 58b now rotates in the clockwise direction, then due to the offset angle at which the radial axis of the tooth 74a is positioned, tooth 74a will be rotated through an angle $\beta_2$, which is relatively small, by the action of drive pawl 58b thereon. This amount of movement of fourth wheel and pinion 74 is not sufficient for tooth 74b to be brought out of the range of attraction of positioning magnet 71, so that fourth wheel and pinion 74 returns to its previous position after drive pawl 58b has rotated out of contact with tooth 74a. If, on the other hand, drive pawl 58b rotates in the counterclockwise direction, from the position shown in FIG. 3, then the offset angle at which tooth 74a is positioned results in tooth 74a being rotated through a relatively large angle, $\alpha_2$. The amplitude of the resultant movement of the fourth wheel and pinion 74 is sufficient to rotate tooth 74b out of the range of attraction by positioning magnet 71, and the succeeding tooth after tooth 74b is then attracted by positioning magnet 71, whereupon a condition of equilibrium of the fourth wheel and pinion 74 is again established. A net rotation of the fourth wheel and pinion 74 through an angle corresponding to one tooth pitch thereof has thus been performed, as a result of the action of drive pawl 58b upon tooth 74a as drive pawl 58b rotates in the counter-clockwise direction. From the foregoing it can be seen that the action of the positioning magnet 71 upon the teeth of the seconds transmission wheel 70 and the fourth wheel and pinion 74, in conjunction with the positioning relationships between the seconds transmission wheel 70, fourth wheel and the pinion 74, drive pawl 58b and positioning magnet 71 enables selective rotation of the fourth wheel and pinion 74 and seconds transmission wheel 70 in accordance with the direction of rotation of drive pawl 58b.

The drive pawl 58b is stationary in an orientation where it is not in engagement with the seconds transmission wheel 70 and the fourth wheel and pinion 74, as shown in FIG. 3. The pawl 58b rotates in the clockwise direction upon each arrival of the 1 Hz seconds advance signal 54a, and drives the seconds transmission wheel 70 and seconds wheel 72 to advance the seconds hand 62 by one second interval. In this instance, the pawl 58b engages a tooth 74a of the fourth wheel and pinion 74, to rotate the fourth wheel and pinion 74 counter-clockwise through an angle of $\beta_2$. In this case, the preceding tooth 74b of the fourth wheel and pinion 74 is still located near the positioning magnet 71 and retracted thereby so that the fourth wheel and pinion 74 is rotated clockwise to its initial position. Thus, the fourth wheel and pinion 74 cannot advance by one tooth during clockwise rotation of the pawl 58b. The pawl 58b engages the tooth 70b of the seconds transmission wheel 70 during clockwise rotation of the pawl 58b, to rotate the seconds transmission wheel 70 through an angle of $\alpha_1$ (corresponding to the circular pitch of the wheel 70) against the retraction force of the positioning magnet 71 exerted on the tooth 70c of wheel 70. In this manner, the clockwise rotation of the pawl 58b causes the seconds transmission wheel 70 to advance by one tooth. Next, 0.5 seconds after the arrival of the 10th seconds advance signal 54a, the minutes and hours advance signal 54b, namely the 1/10 Hz signal that is to rotate the electromechanical transducer 58 in the opposite direction, is produced so that the drive pawl 58b rotates in the counter-clockwise direction and drives the fourth wheel and pinion 74 which is positioned by the magnet 71, the third wheel and pinion 76, center wheel and pinion 78 carrying the cannon pinion 80 that mounts the minutes hand 66, the minutes wheel 82, and the hours wheel 84 that mounts the hours hand 68. In this instance, the pawl 58b engages the tooth 70b of the seconds transmission wheel 70, to rotate the seconds transmission wheel 70 through an angle $\beta_1$. In this case, the preceding tooth 70c of the wheel 70 is still located near the positioning magnet 71 and retracted thereby so that when the pawl 58b disengages from the tooth 70b of the wheel 70 during counterclockwise rotation of the pawl 58b, the wheel 70 is rotated counterclockwise to its initial position due to the retracting force of the magnet 71 exerted on the tooth 70c. The pawl 58b engages with the 74a of the fourth wheel and pinion 74 during counter-clockwise rotation of the pawl 58b, to rotate the fourth wheel and pinion 74 clockwise through an angle $\alpha_2$ against the retraction force exerted on the tooth 74b of the wheel 74. Thus, the fourth wheel and pinion 74 is advanced by one tooth.

The present embodiment was described based upon driving the seconds hand; in view of the positions of the hours and minutes hands whenever an on-the-time is reached, it is preferable to drive the seconds hand after the operation of the hours and minutes hands has been completed. This is advantageous because there will not be any discrepancy in the alignment of the hands on-the-time.

The role of the positioning magnet 71 can also be accomplished by the provision of a pair of magnets for each wheel 70, 74, or by brining a positioning spring into suitable engagement with the wheels 70, 74, or by using a Geneva gear. Although it is permissible to advance the minutes and hours hands at a rate of one advance per second, it is beneficial in terms of power consumption to advance the hands at intervals of two seconds or more. Alternatively, the energy for producing the minutes and hours advance signals can be increased by raising the voltage. Further, although two time indicating members can be driven at a timing which can be chosen quite freely, it is desirable that they be driven at substantially equivalent intervals in view of a drop in battery voltage which accompanies the current expenditure. In the case of a two-hand timepiece, the minutes and hours hands may be driven separately.

In accordance with the present invention, a number of time display members are driven by means of separate wheel trains, whereby the rotational frequency of the time display members can be more freely set while the number of driving operations can be decreased, depending upon the type of display. Moreover, as these separate wheel trains are not all driven at the same time, losses due to inertia, air resistance, friction and the like are reduced so that the output of the electro-mechanical transducer can be decreased, thereby conserving power.

Figure 5:
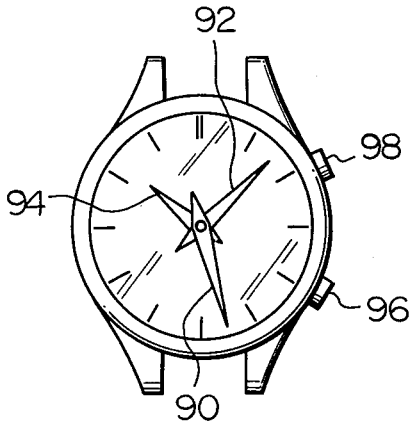

With reference to FIG. 5, there is shown a plan view of the external appearance of a second preferred embodiment of an electronic timepiece. In FIG. 5, a seconds hand 90 advances at a rate of one step per second, and an minutes hand 92 and hours hand 94 advance once every ten seconds in step-wise fashion while the seconds hand 90 is at rest. If a seconds correction button 96 is depressed, the seconds hand 90 alone will advance by one second each time the button is depressed; if the button 96 is depressed continuously for more than two seconds, the seconds hand will advance at a rate of 16 seconds for each second the button 96 is depressed. If an hours and minutes correction button 98 is depressed, the minutes hand 92 and hours hand 94 will advance by one step (by an amount equal to 10 seconds or 1/6 of the distance between minute graduations) each time the button 98 is depressed; if the button 98 is depressed continuously for more than two seconds, the minutes and hours hands will advance at a rate of 64 steps (by an amount equal to 640 seconds or a distance of 10 4/6 minute graduations) for each second the button 98 is depressed. If both the seconds correction button 96 and hours and minutes correction button 98 are depressed, the seconds hand 90, minutes hand 92 and hours hand 94 will come to rest but will begin moving again when the buttons are released.

Figure 6:
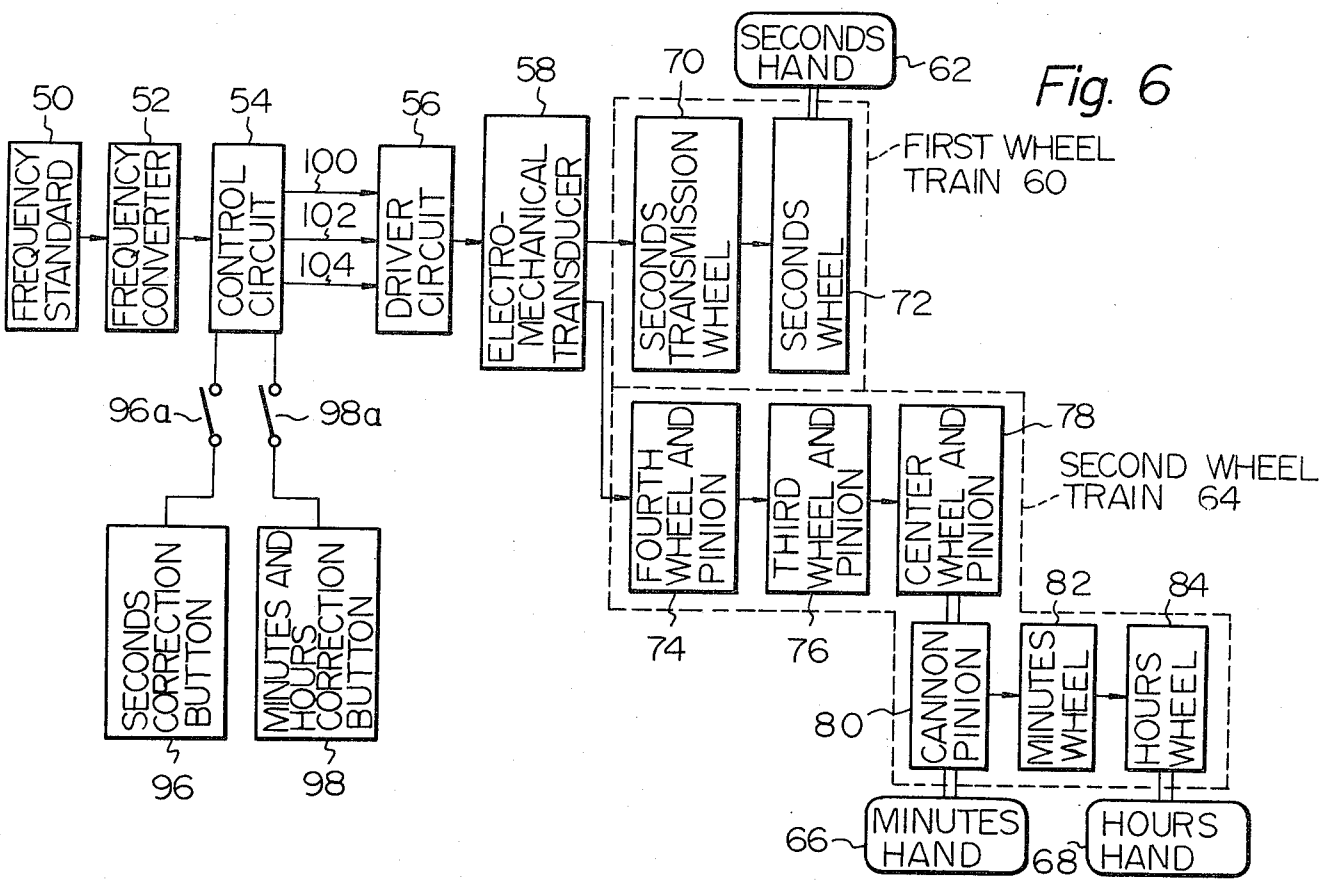

FIG. 6 is a block wiring diagram of the timepiece shown in FIG. 5, with like parts bearing the same reference numerals as those used in FIG. 2. A signal produced by a frequency standard is divided by a frequency converter 52 and fed to a control circuit 54. The control circuit 54 is arranged to produce a normal drive signal 100, seconds correction signal 102 as well as an hours and minutes correction signal 106, respectively denoted by waveforms (a), (b) and (c) in FIG. 7. Thus, in response to the operational state of external control members, namely the two correction buttons, the control circuit is adapted to perform a switching function so as to supply a driver circuit 56 with the normal drive signal 100 when both buttons are in the normally non-depressed state, with the seconds correction signal 102 when the seconds correction button 96 is depressed, with the hours and minutes correction signal 104 when the hours and minutes correction button 98 is depressed, and with no signal when both buttons are depressed. The driver circuit 56, responsive to the signals it receives, drives an electro-mechanical transducer 58 which is capable of rotating in the clockwise and counter-clockwise directions. Rotation of electro-mechanical transducer 58 in one direction drives, through the intermediary of a seconds transmission wheel 70, a second wheel 72 which mounts the second hand 62, while rotation in the other direction rotates, through the intermediary of a fourth wheel and pinion 74 and third wheel and pinion 76, a center wheel and pinion 78 integrated with cannon pinion 80 which mounts the minutes hand 66, thereby to drive, via a minutes wheel 82, an hours wheel 84 which mounts an hour hand 68.

Figure 7:
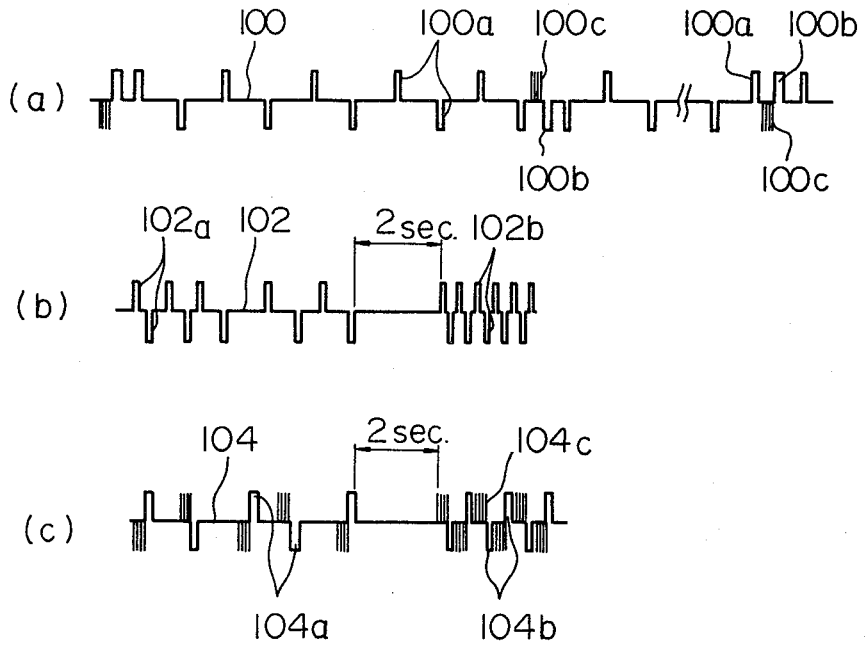
FIG. 7 is a timing chart showing the waveforms associated with the circuitry shown in FIG. 6.

With reference to FIG. 7 for an explanation of the waveforms, the normal drive signal 100 is composed of 10 alternatingly positive and negative seconds advance signals **100*a* spaced one second apart for rotating the electro-mechanical transducer 58 in the clockwise direction, and an hours and minutes advance signal 100*b* which occurs approximately 0.5 seconds after the 10th seconds advance signal 100*a* in order to rotate the transducer in the counter-clockwise direction. A number of extremely narrow pulses 100*c* which appear directly before the hours and minutes advance signal 100*b* is an auxiliary signal that allows the transducer to smoothly reverse in direction. The seconds correction signal 102 is composed of singly produced signals 102*a* each of which is generated for every single depression of the seconds correction button 96, and a series of pulse signals 102*b* produced at a frequency of 16 Hz if the button is depressed continuously for more than two seconds. The hours and minutes correction signal 104 is composed of singly produced pulse signals 104*a* each of which is generated for every single depression of the hours and minutes correction button, and a series of pulses 104*b* produced at a frequency of 64 Hz if the button is depressed continuously for more than two seconds. The narrow pulses 104*c*, as in the case of the pulses 100*c* in FIG. 7**, is an auxiliary signal that allows the transducer to smoothly reverse in direction.

In cases where the singly produced pulses **102*a* and the series of pulses 102*b* are produced, the electro-mechanical transducer 58 is rotated in the clockwise direction so that the rotation of the drive pawl 58*b* (see FIG. 3) is transmitted solely to the seconds transmission wheel 70, thereby rotating only the seconds hand 62 in the clockwise direction independently of the hours hand 68 and minutes hand 66. On the other hand, in a case where an hours and minutes correction signal 104, i.e., singly produced pulses 104*a* and the series of pulses 104*b* are produced, the transducer is rotated in the counter-clockwise direction so that the rotation of the drive pawl 58*b* is transmitted solely to the second wheel train 64, thereby rotating solely the hours hand 68 and minutes hand 66 in the clockwise direction independently of the seconds hand 62**.

In accordance with the present invention mentioned above, time indicating members are driven by separate drive systems so that it is possible to independently correct each time indicating member electrically in a rapid manner even though the maximum rotational speed of the electro-mechanical transducer does not attain a high value. Moreover, the timepiece of the invention is advantageous in that world time differences can be rapidly corrected in a case where the hours hand alone is adapted to be independently corrected.

What is claimed is:

1. In an electronic timepiece having a frequency standard for providing a relatively high frequency signal, a frequency converter for providing a low frequency time unit signal in response to the relatively high frequency signal, a control circuit responsive to the time unit signal to provide first and second output signals, and a driver circuit responsive to said first and second output signals to provide first and second drive signals, the improvement comprising:

a single reversible electro-mechanical transducer driveable in a clockwise direction and in a counter-clockwise direction in response to said first and second drive signals respectively;

first time-indicating hand means for indicating time;

second time-indicating hand means for indicating time;

a first wheel train driven by said electro-mechanical transducer during clockwise rotation thereof to actuate said first time indicating hand means; and a second wheel train independent of said first wheel train and driven by said electro-mechanical transducer during counter-clockwise rotation thereof to actuate said second time indicating hand means.

2. The improvement according to claim 1, in which said first time indicating hand means comprises a seconds hand, and said second time indicating hand means comprises a minutes hand and an hours hand.

3. The improvement according to claim 2, in which said first wheel train comprises a seconds transmission wheel driven in response to the clockwise rotation of said electro-mechanical transducer and a seconds wheel meshing with said seconds transmission wheel and connected to said seconds hand, and said second wheel train comprises a fourth wheel and pinion driven in response to the counter-clockwise rotation of said electro-mechanical transducer, a third wheel and pinion in mesh with said fourth wheel and pinion, a center wheel and pinion in mesh with said third wheel and pinion, a cannon pinion integral with said center wheel and pinion and connected to said minutes hand, a minutes wheel meshing with said cannon pinion, and an hours wheel meshing with said minutes wheel and connected to said hours hand.

4. The improvement according to claim 3, in which said electro-mechanical transducer comprises a rotor having a driving pawl to drive said seconds transmission wheel in a clockwise direction and said fourth wheel and pinion in a counter-clockwise direction.

5. The improvement according to claim 4, further comprising means for positioning said seconds transmission wheel and said fourth wheel and pinion relative to the driving pawl of said rotor.

6. The improvement according to claim 2, in which said electronic timepiece also has a seconds correction button to perform correction of said seconds hand, and a minutes and hours correction button to perform correction of said minutes hand and said hours hand.

7. In an electronic timepiece having a frequency standard for providing a low frequency time unit signal, a frequency converter for providing a low frequency time unit signal in response to the relatively high frequency signal, a control circuit responsive to the time unit signal to provide first and second output signals, and a driver circuit responsive to said first and second output signals to provide first and second drive signals, the improvement comprising:

a first electro-mechanical transducer driven in response to said first drive signal;

a second electro-mechanical transducer driven in response to said second drive signal;

first time indicating hand means;

second time indicating hand means;

a first wheel train driven by said first electro-mechanical transducer to actuate said first time indicating hand means; and a second wheel train driven by said second electro-mechanical transducer to actuate said second time indicating hand means.

8. The improvement according to claim 7, in which said first time indicating hand means comprises a minutes hand, and said second time indicating hand means comprises an hours hand.

9. The improvement according to claim 8, in which said first wheel train comprises a minutes transmission wheel driven by said first electro-mechanical transducer, and a minutes wheel meshing with said minutes transmission wheel and connected to said minutes hand, and said second wheel train comprises an hours wheel driven by said second electro-mechanical transducer and connected to said hours hand.

* * * * *